US005226941A

United States Patent [19]

Uibel et al.

[11] Patent Number: 5,226,941

[45] Date of Patent: Jul. 13, 1993

[54] DUST FILTER BAG

[75] Inventors: Paul U. Uibel, Ennepetal; Betra Lehmann, Essen, both of Fed. Rep. of Germany

[73] Assignee: Vorwerk & Co. Interholding GmbH, Wuppertal, Fed. Rep. of Germany

[21] Appl. No.: 854,423

[22] Filed: Mar. 19, 1992

[30] Foreign Application Priority Data

Apr. 24, 1991 [DE] Fed. Rep. of Germany ..... 9105039

[51] Int. Cl.[5] ..... B01D 46/04

[52] U.S. Cl. ..... 55/367; 55/369; 55/367; 55/377; 55/DIG. 2

[58] Field of Search ..... 55/367, 369, 373, 376, 55/377, 508, DIG. 2

[56] References Cited

U.S. PATENT DOCUMENTS 2,964,128 12/1960 Bartos et al. ..... 55/373 X
3,432,998 3/1969 Downey et al. ..... 55/377 X
3,495,386 2/1970 Bixler et al. ..... 55/367
3,933,451 1/1976 Johansson ..... 55/367

FOREIGN PATENT DOCUMENTS 00246360 3/1981 European Pat. Off. .
9001528 4/1990 Fed. Rep. of Germany .
9016534 2/1991 Fed. Rep. of Germany .
9016939 4/1991 Fed. Rep. of Germany .
1146843 11/1957 France .

*Primary Examiner*—Charles Hart
*Attorney, Agent, or Firm*—Martin A. Farber

[57] ABSTRACT

A duct filter bag (1) for a vacuum cleaner having a holding plate (2, 15) which has a tightly closed opening (4) for a pipe connection of a vacuum cleaner, the opening being adapted to be closed from the outside by a separate closure flap (5) which has an insertion region (8, 9, 11). In order to make the dust filter bag (1) more favorable in use, the closure flap (5) is hinged to the holding plate (2) laterally of its region of swing (V).

12 Claims, 4 Drawing Sheets

FIG. 4
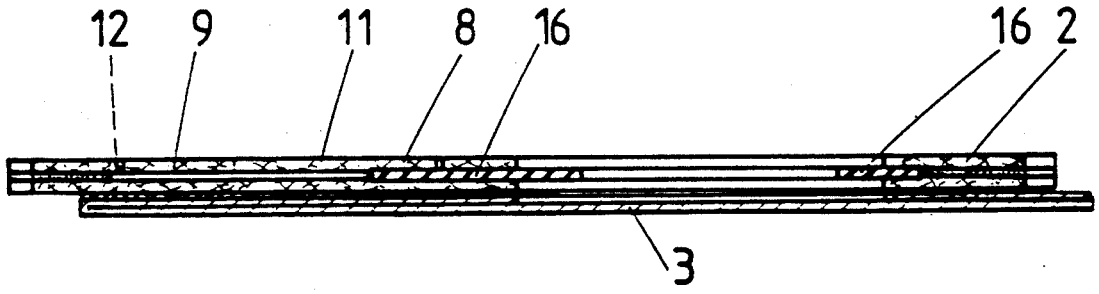
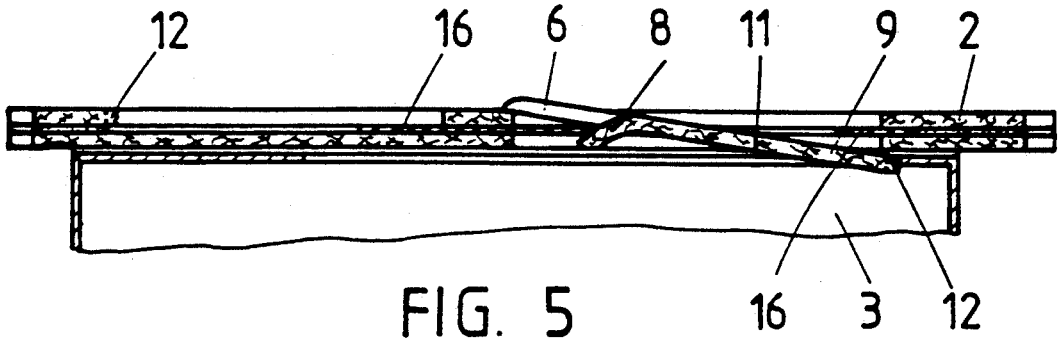
FIG. 5

DUST FILTER BAG

FIELD AND BACKGROUND OF THE INVENTION

The present invention relates to the dust filter bag for a vacuum cleaner, having a holding plate which has a tightly closed opening for a pipe connection of the suction part of a vacuum cleaner, the opening being adapted to be closed from the outside by means of a separate closure flap which has an insertion region.

Such dust filter bags are already known in various developments. Reference is had in this connection for example to German Utility Model 78 32 780. From German Unexamined Application for Patent 23 56 732 it is furthermore known to provide the holding plate with a handle which is primarily intended to facilitate assembly upon the insertion of the dust filter bag into a vacuum cleaner. Finally, reference is also had to German Utility Model 90 01 528 from which it is known to develop a separate, outer insertion tab which can be swung in order to close the opening and can be inserted into, the opening.

However, such a closure is still not always found satisfactory upon handling. There is furthermore a need to be able better to handle the vacuum cleaner bag after its removal from the vacuum cleaner, particularly in fully filled condition.

SUMMARY OF THE INVENTION

Proceeding from the above-described prior art, it is the object of the invention to provide a dust filter bag which is favorable in use.

According to the invention the closure flap is articulated on the holding plate to the side of its region of swing, i.e., the region of swing of the actual insertion region. This measure results in substantially greater freedom in the development of the closure flap. In the direction of swing, the insertion region can develop insertion tabs on two opposite sections, said tabs being adapted to engage under the edge of the opening when closed. In this way there is established an easily handled possibility of form-locked attachment of the closure flap in the opening. If, for instance, a arm is merely developed to which the closure pocket is articulated laterally of its region of swing on the holding plate, then an insertion tab can even in addition be developed on the closure flap opposite the area of attachment of the arm. In another development, it is provided that the closure flap is articulated on the holding plate via two arms. Each of these arms can have the shape of the circular arc. They can, in addition, preferably be developed symmetrical to each other. It is furthermore preferred that an axis of symmetry extends centrally through the closure flap. It is furthermore preferred that an insertion tab be developed on the closure flap, extending on both sides of the arm or arms. In this connection, it is further preferred that the one insertion tab which is located outside the circular arc of the arms, be made larger than the insertion tab which extends within the circular arc of the arms. Each of the insertion tabs preferably consist of a circular region, which regions however are spaced from each other by a section of rectangular contour, again preferably in the manner that the above-described as a whole larger insertion tab (as seen together with said rectangular section) results on one side. As further development, the invention also proposes that the closure flap be connected to a handle by a tear-off strip. In delivered condition, the handle is in this way firmly attached to the closure flap. Upon insertion of the dust filter bag into a vacuum cleaner, favorable handling results in the manner that the closure flap can easily be held fast via the larger, i.e., further outwardly extending handle. This also due to the fact that the handle is developed larger than the arms of the closure flap. This is established geometrically in the manner that the handle extends outside the circular arc of the arms. The handle can also preferably be attached on the work side to the holding plate by an adhesive spot or the like. In this way, it is not necessary, upon the insertion of the dust filter bag, to take the handle into account or manipulate it separately. For closing the dust filter bag or the opening therein from the outside, after removal of the dust filter bag from the vacuum cleaner, the closure flap can simply be swung by its relatively large handle into its closing position. By pressing the closure flap into the opening, so that the insert regions engage below the opening, the separation of the tear-off strip from the handle can be effected by simply pressing on the closure flap. The preferably hoop-shaped handle can then swing back again or simply be swung upward and serve as carrying handle for the dust filter bag which has been closed in this manner. In this connection it has proven to be particularly advantageous for the handle and the arm/arms of the closure flap to be swingable approximately around the same axis of swing.

BRIEF DESCRIPTION OF THE DRAWINGS

The invention will be explained in further detail below with reference to the accompanying drawing which however merely shows one embodiment. In the drawing:

FIG. 4 is a cross section through the cover plate of the dust filter bag of FIG. 2, taken along the line IV—IV; and FIG. 5 is a cross section through the cover plate of the dust filter bag of FIG. 3, taken along the line V—V.

DETAILED DESCRIPTION OF THE PREFERRED EMBODIMENT

Figure 1:
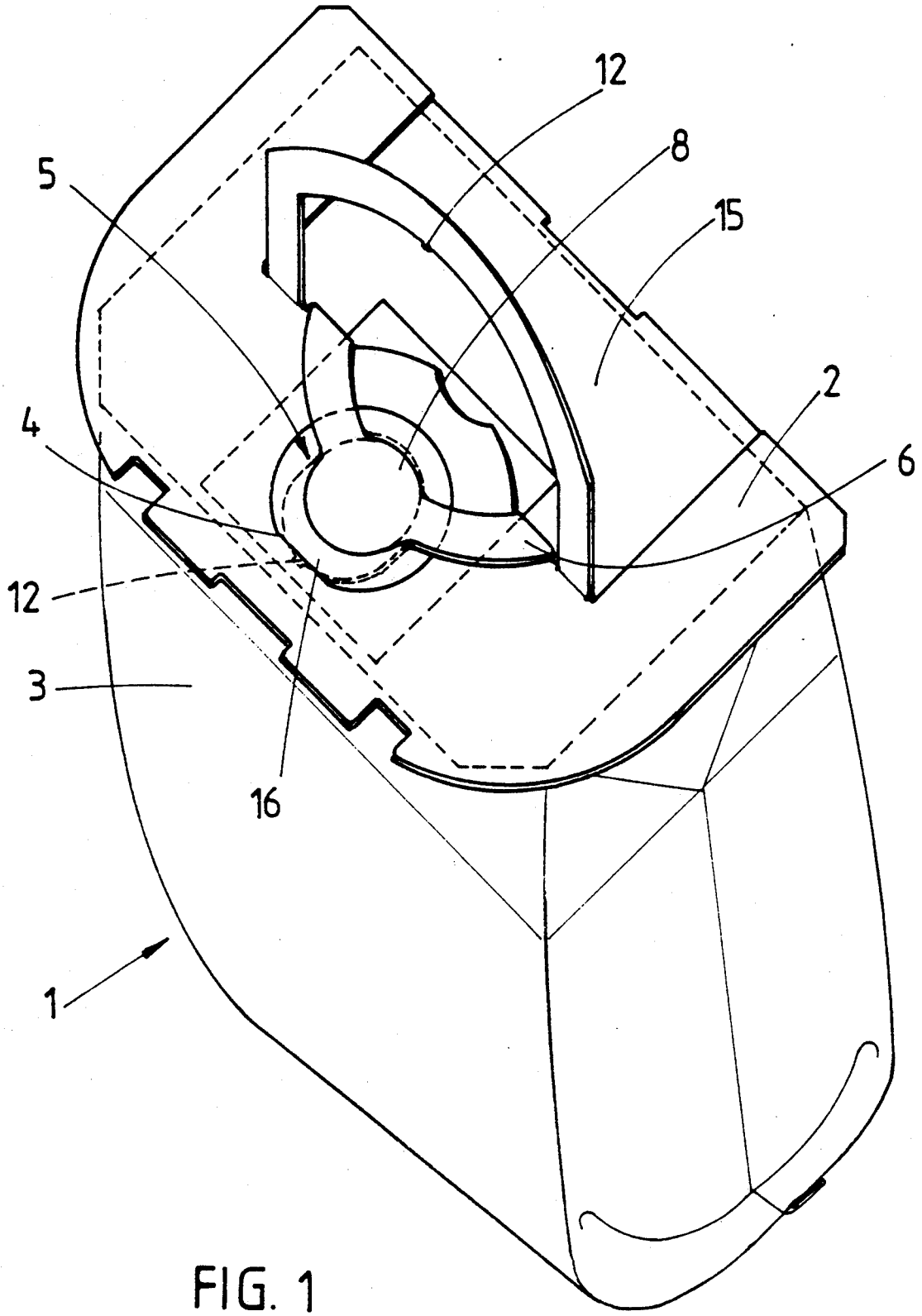
FIG. 1 is a perspective view of a dust filter bag.

There is shown and described first with reference to FIG. 1—a dust filter bag 1 having a cover plate 2, such as can be used in particular in an electric vacuum cleaner.

While the dust filter bag 3 proper consists of a flexible cellulose material, the cover plate 2 is usually formed of a stable cardboard material. An opening 4 is provided in the cover plate 2, into which opening pipe a connection of the vacuum cleaner is introduced when installed in the vacuum cleaner. In the closed position of the closure flap 5 shown in FIG. 1, the flap is inserted into the opening 4, as is done after the dust filter bag 1 has been used and is full.

Figure 2:
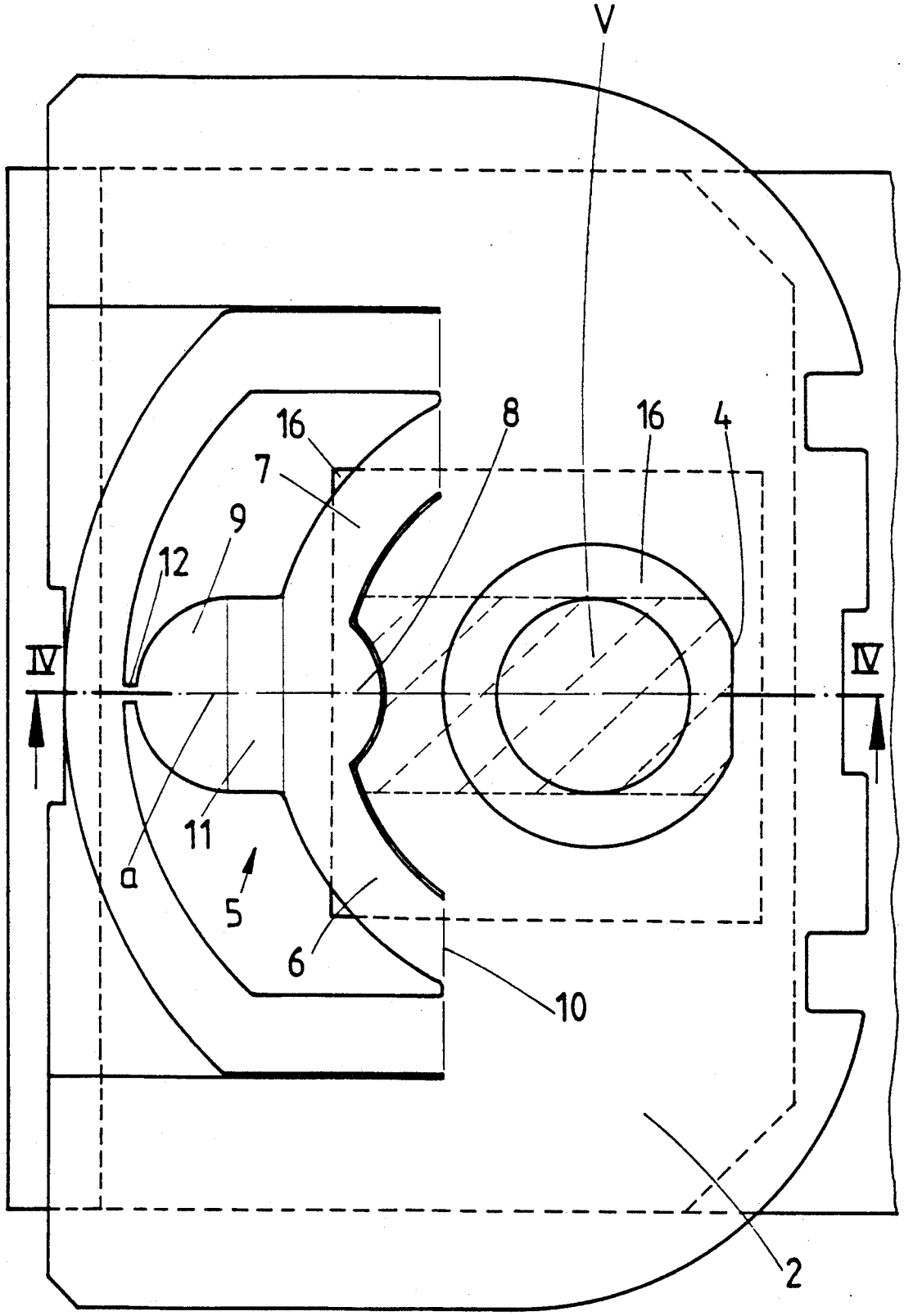
FIG. 2 is a top view of the cover plate of the dust filter bag in delivered condition.

As can be noted in particular from FIG. 2, which shows the delivered condition of the dust filter bag 1, the closure flap 5 is hinged on the holding plate 2 to the side of its region of swing V. In detail, this is effected by two arms 6, 7 which pass into the holding plate 2 and can be swung along a fold line 10. In the embodiment shown, the arms have the shape of circular arcs. They are furthermore symmetrical to each other. The closure flap 5 as a whole is symmetrical to its center line a.

The closure flap 5 forms in addition two insertion tabs 8, 9 which extend on both sides of the arms 6, 7. "On both sides" means that the insertion tabs 8, 9 extend on both sides of the area of connection of an arm 7 or 6 to the closure flap 5. The insertion tabs 8, 9 are each developed as a semicircular or circular segment but they are spaced from each other by a rectangular area 11. (The boundary lines of the area 11 are shown for clarification in the drawing; actually, they do not constitute either bending places or shoulders or the like of the closure flap 5. Of course, such places may however also be present.)

Furthermore, the closure flap 5 is provided via a tear-away arm 12 with a handle 13. The handle 13 is of yoke-shape as a whole. It surrounds the arms 6, 7 outside the circular arc indicated thereby. Due to the fact that the rectangular area 11 of the closure flap 5 and an approximately semicircular region of the insertion tab 9 also extend outside the circular arc described by the arms 6, 7, a substantial space is present between the arms 6, 7 and the handle 13 or the upper region thereof which is also in the shape of a circular segment. In this way, there is also established a relatively large lever arm to the axis of swing 10, which is identical for the handle 13 and the closure flap 5. In the region of the axis of swing 10, the lower arms of the handle 13 and the arms 6, 7 of the closure flap 5 are, to be sure, arranged approximately directly alongside each other.

Figure 3:
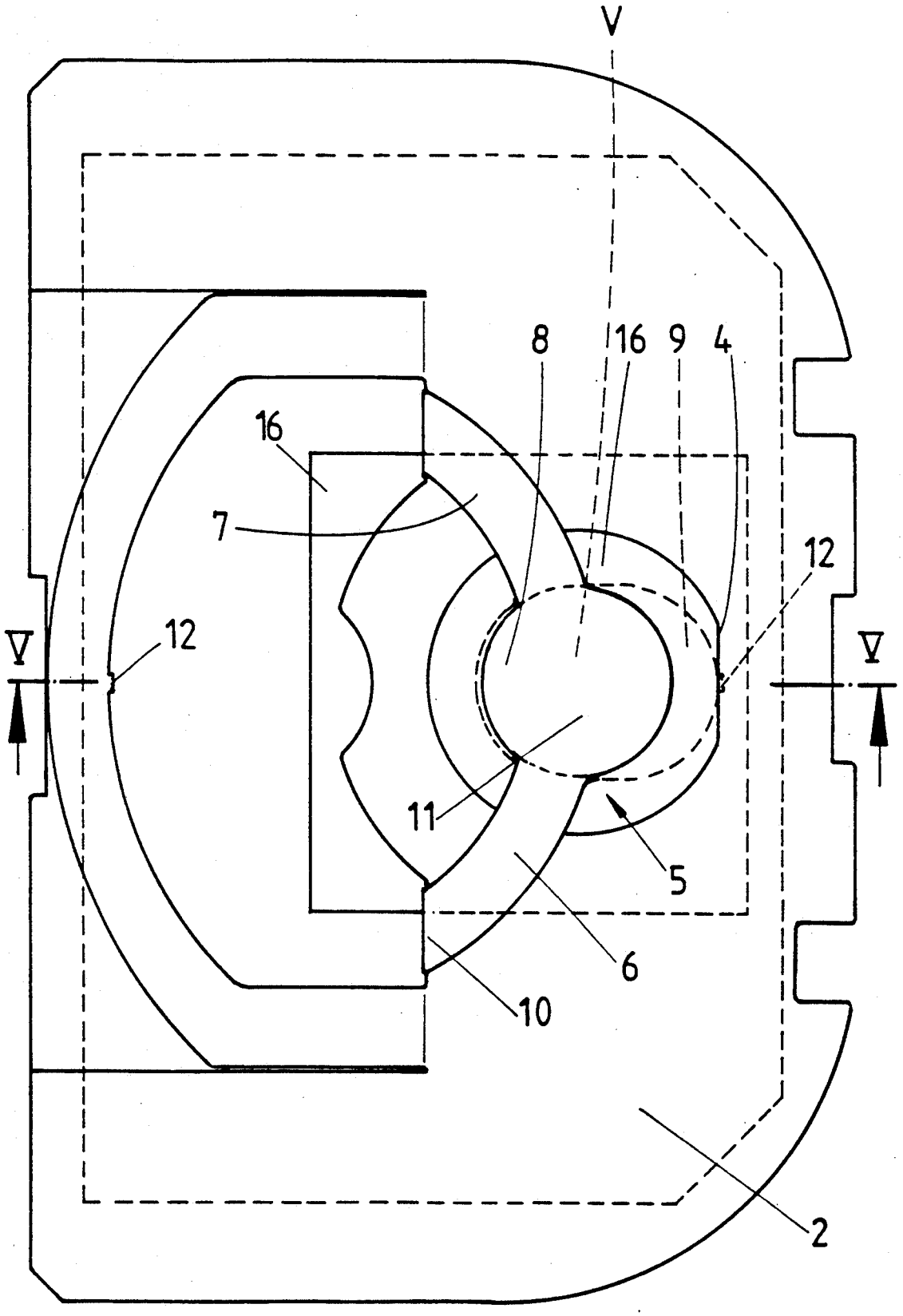
FIG. 3 is a top view according to FIG. 2, with the opening of the dust filter bag closed.

As can be noted in particular from the sectional view of FIG. 4, the bag 3 proper is connected to the cover plate 2 by a gluing 14. In the case of the embodiment shown, the cover plate 2 is furthermore formed of two layers, the closure flap 5 and the handle 13 being formed from the upper layer, for instance by stamping or cutting. The lower layer 15 of the cover plate 2 is continuous, with the exception of the opening 4 which is formed in alignment, in both the upper and the lower layer. Between the upper layer and the lower layer 15 of the cover plate 2, a rubber ring 16 is for instance also clamped in the region of the opening 4, said rubber ring forming, a sealing collar for the opening. The insertion tabs 8 and 9 (see also FIG. 3) also grip below the rubber ring 16.

We claim:

1. A dust filter bag for a vacuum cleaner having a holder plate which has a tightly closed opening for a suction pipe of a vacuum cleaner, the opening being adapted to be closed from the outside by a separate closure flap which has an insertion region, the bag including a handle, wherein the closure flap is attached to said handle by a tear strip.

2. A dust filter bag according to claim 1, wherein the handle is yoke-shaped.

3. A dust filter bag according to claim 1, wherein the handle and an arm of the closure flap are swingable around approximately the same axis of the swing.

4. A dust filter bag according to claim 1, wherein the closure flap is hinged on the holding plate laterally of its region of swing.

5. A dust filter bag according to claim 1, wherein the closure flap is hinged on the holding plate via two arms.

6. A dust filter bag according to claim 5, wherein the arms are developed as circular segments.

7. A dust filter bag according to claim 5, wherein an insertion region of the closure flap comprises an insertion tab extending on both sides of at least one of the arms.

8. A dust filter bag according to claim 1, wherein the insertion region comprises two circular segment-shaped regions which are spaced from each other by a rectangular section.

9. A dust filter bag for a vacuum cleaner having a holding plate which has a tightly closed opening for a pipe connection of a vacuum cleaner, the opening being adapted to be closed from the outside by a separate closure flap which has an insertion region, wherein the closure flap is hinged on the holding plate laterally of its region of swing; and wherein the closure flap is connected to a handle via a tear arm.

10. A dust filter bag according to claim 9, wherein the handle is yoke-shaped.

11. A dust filter bag according to claim 9, wherein the handle and an arm of the closure flap are swingable around approximately the same axis of swing.

12. A dust filter bag according to claim 5 wherein, the closure flap is hinged on the holding plate via the arms at a distance from the opening.

* * * * *